United States Patent [19]

Chevalier

[11] Patent Number: 4,946,308

[45] Date of Patent: Aug. 7, 1990

[54] EROSION-CONTROL MATTING AND METHOD FOR MAKING SAME

[76] Inventor: Donald M. Chevalier, 248 15th Ave., S., Great Falls, Mont. 59405

[21] Appl. No.: 268,272

[22] Filed: Nov. 7, 1988

Related U.S. Application Data

[63] Continuation-in-part of Ser. No. 909,906, Sep. 22, 1986, abandoned.

[51] Int. Cl.[5] ..... E02B 3/12

[52] U.S. Cl. ..... 405/15; 405/19; 405/32; 428/224

[58] Field of Search ..... 405/15, 16, 17, 19, 405/21, 27, 32; 428/221, 222, 224, 225, 229

[56] References Cited

U.S. PATENT DOCUMENTS

| | | | |
|---|---|---|---|
| 3,696,623 | 10/1972 | Heine et al. | 405/19 |
| 3,842,606 | 10/1974 | Stiles et al. | 405/19 |
| 3,928,701 | 12/1975 | Roehner | 405/30 X |
| 4,150,909 | 4/1979 | Hibarger et al. | 405/27 |
| 4,629,651 | 12/1986 | Davis | 405/17 X |

FOREIGN PATENT DOCUMENTS

| | | | |
|---|---|---|---|
| 1222743 | 4/1986 | U.S.S.R. | 405/17 |
| 1022319 | 3/1966 | United Kingdom | 405/19 |
| 2006689 | 5/1979 | United Kingdom | 405/27 |

*Primary Examiner*—David H. Corbin

*Attorney, Agent, or Firm*—Francis X. LoJacono

[57] ABSTRACT

An erosion-control matting and method for making the matting wherein the matting is used for controlling certain erosion conditions, particularly with respect to erosion of soil and sand by the action of water. The matting is formed by cutting a vehicle tire into a continuous elongated strip and attaching at least two strips together, end-to-end, to form a continuous length of rubber striping which is then wound onto a spool. A multiplicity of strip-loaded spools are positioned longitudinally so as to be received in a weaving machine, with a single spool being positioned to dispense a rubber strip transverse to the longitudinally disposed rubber strips, whereby the strips are woven to form an interwoven rubber matting, the configuration thereof being predetermined for the required use.

20 Claims, 4 Drawing Sheets

Fig. 3.
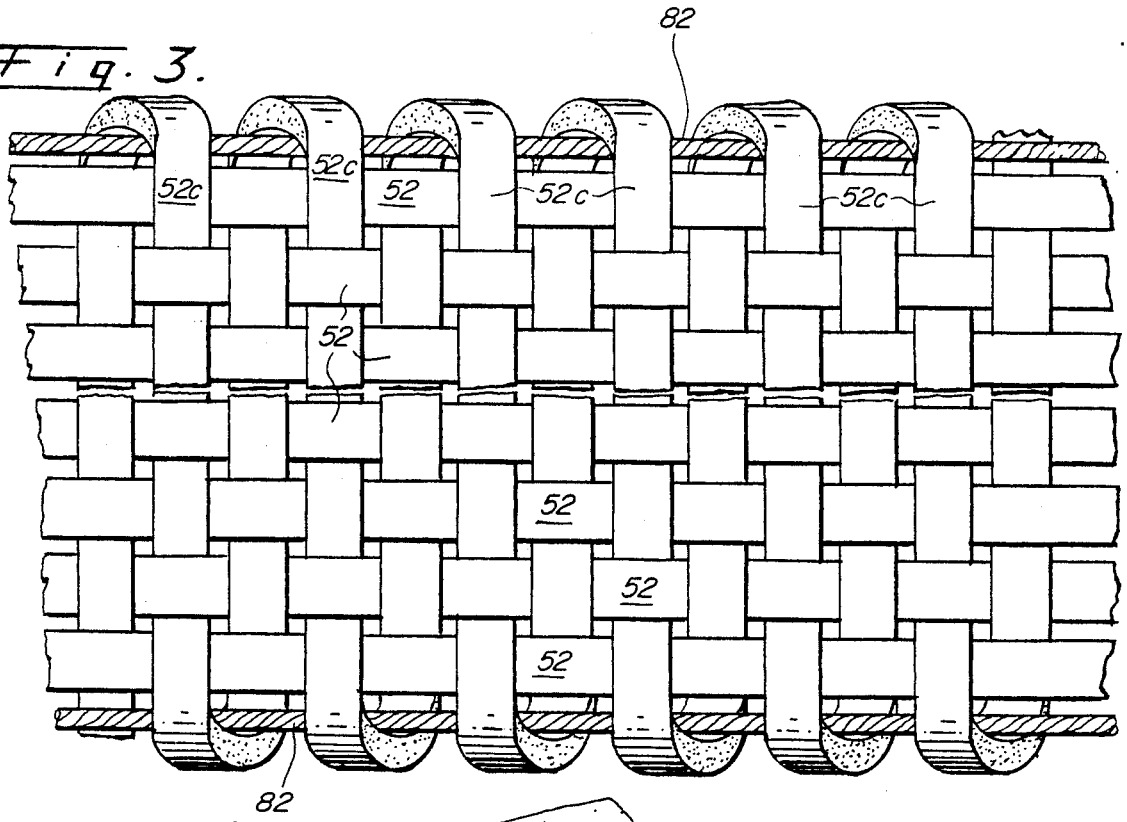
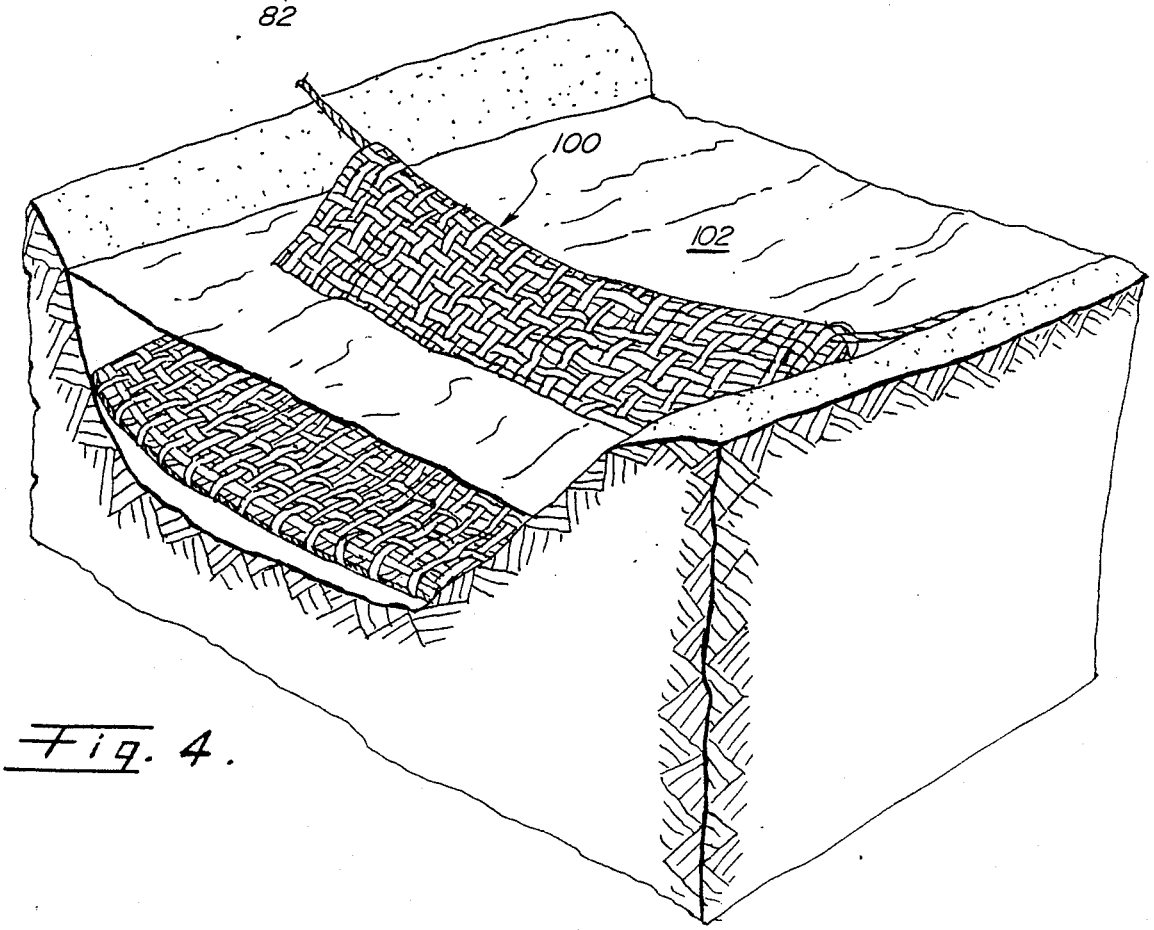
Fig. 4.

EROSION-CONTROL MATTING AND METHOD FOR MAKING SAME

CROSS-REFERENCE

This application is a Continuation-In-Part of parent application Ser. No. 06/909,906 filed Sept. 22, 1986, by the above-named inventor, entitled EROSION CONTROL MATTING, and which is now abandoned.

BACKGROUND OF THE INVENTION

1. Field of the Invention

This invention relates to the general field of erosion control, and more particularly to the method of forming erosion-control matting for use in the protection from moving water along stream banks, canals, irrigation conduits, sewage-treatment ponds, roadside ditches, coastal beaches and reltated applications.

Description of the Prior Art

The traditional form of erosion control has largely consisted or rock in various forms dumped or placed in a position to minimize the erosive effects of moving water.

There are many other forms of erosion mitigation including gabions, revetments, fences, seawalls, concrete in various forms and configurations, whole rubber tires both laid flat on the erosion surface (see patent #3,842,606 and 4,139,319) and stacked vertically one on top of the other, manufactured plastic sheathing and netting, and many other forms.

There are a number of claims relating to erosion control. As some examples of prior art one may refer to the following patents:

Twele: U.S. Pat. No. 3,455,112
Muhring: U.S. Pat. No. 4,002,034
Nielsen: U.S. Pat. No. 4,405,257
de Winter: U.S. Pat. No. 4,417,828

Although all the foregoing use some form of matting, none of them use rubber, or an interwoven rubber material combined with a cable or similar reinforcement along each side.

Still additional examples of prior art:

Smedley: U.S. Pat. No. 3,161,026
Danz: U.S. Pat. No. 3,426,536
Stiles: U.S. Pat. No. 3,842,606
Crow, Hansen: U.S. Pat. No. 4,375,928
Burg & Hoedt: U.S. Pat. No. 4,421,439 are further removed from the nature of this invention in that none of them uses a cut rubber matting, cable anchoring or varied weave densitites.

It is estimated that using the matting described in this invention it would cost approximately $75 per lineal foot to provide a high level of erosion control, heretofore not possible in the art.

The combination of qualities of flexibility, durability, easy installation and transportability will make this invention a favored material for emergency situations involving heavy rainstorms, spring runoff or other unusual high-energy water conditions which may create life threatening situations.

Another series of applications for this invention include coastal-erosion control. There are over 20,000 miles of coastline in the United States, much of it subjected to erosion and some of it, in recent years subjected to severe erosion, including 3,000 miles which are considered to be in critical danger.

One of the major concerns, particularly on the Atlantic coast, it that the water level has been rising and this increase has accelerated in the last 50 years to a rate of 1½ feet per century. The most serious and persistent erosion occurs on low sandy beaches of the Atlantic and Gulf coasts.

On these gently sloping coastal plains, a small rise in sea level will increase the horizontal inland reach of the sea by many times its vertical measure. The average rate of long-term shoreline erosion varies greatly but, measured on an annual basis, it probably averages two to three feet per year. In some cases, it averages ten feet per year. Even if a precise measure of the rise of sea level can be argued, there is no doubt that most of the American shoreline is receding and the sea is advancing. In fact, the E.P.A. predicts that by the year 2,100, sea level will probably stand four feet above the present level.

A few examples of the deteriorating situation on our coastline include:

* More than 72 miles of south-shore Long Island is considered a high-risk zone for development with some locations being reclaimed by the sea at 6 feet per year.
* Most of North Carolina is retreating at 3 to 6 feet per year.
* Much of the Texas coastline is vanishing at an even faster rate.
* California has had 30 relatively mild winters but, in the last 2 or 3 years, the winters have become more severe (possibly more normal) with more extensive coastal damage.

Many older shoreline developments have been protected by various hardening devices. This practice has yielded indisputable evidence that hard stabilization, groins and sea walls eventually degrade the beach. Many miles of beach, including such famous shorefronts as Daytona Beach, Virginia Beach, Myrtle Beach, Ocean City and Atlantic City are much narrower than they were or would have been in their natural state. In some long-developed and long-stabilized communites like Monmouth Beach, N. J., or Galveston, Tex., the beaches have essentially disappeared.

The coastal areas are of critical concern, particularly when it is predicted that, by 1990, 75% of the nation's population will be living within 50 miles of the coastline.

Existing control methods on the coastal beaches have, with very few exceptions, been universally disappointing. Rocks, groins and sea walls only seem to either increase the problem or shift it a few yards down the beach.

A further application for this invention is heavy construction. Wherever there is earthmoving and new artifical slopes created, there would be a potential for the matting. Examples would include highway interchanges and slope erosion control where the matting would prevent erosion and allow for revegetation to take place. The material could also be used in road or highway construction as an underlayer, supporting the upper layers of gravel and asphalt.

The matting would be particularly suitable adjacent to highways to control erosion runoff along the highway edges. Almost every depression adjacent to the highway requires some method of drainage control, usually concrete, where the matting would be a viable alternative. Further application would include mining operations, dam sites, and large projects where potential slope erosion is a factor or secure footings for the movement of equipment in mud and water is required.

One of the most comprehensive studies on erosion control was completed by:

U.S. Army Corp of Engineers

Final Report to Congress

The Streambank Erosion Control

Evaluation and Demonstration Act of 1974

Section 32, Public Law 93-251

Dec. 1981

The report indicated that methods of erosion control have changed very little in this century and that erosion continues to be a formidable and costly problem. The report states that of a total of 3½ million stream bank miles in the nation, 575,000 bank miles have some degree of erosion, while 142,000 bank miles have sever erosion. The 1981 evaluation of erosion damage on stream banks along was estimated to be $340 million per year while the estimated protection costs for serious erosion by conventional methods would be $1.1 million per year.

SUMMARY OF THE INVENTION

This invention is a woven rubber matting comprising endless strips of rubber cut from used vehicle tires which are formed by a unique method of weaving the strips that form the matting. The matting can be woven in a variety of configurations by varying both the width and shape of the stripping and the spacing between the longitudinal and transverse strips.

A common configuration might include rubber stripping 1 inch in width with the strips spaced ½ inch apart. The matting would be woven into various widths depending on the application and would include a steel cable as the outermost longitudinal strip on each side of the matting.

The basic method of forming an interwoven fabric of continuous strips of rubber cut from used vehicle tires includes the mounting of a used tire on a stripping device which strips the tire into a continuous strip which is cut into a predetermined width, thickness and shape. The strips from several tires are coupled end-to-end in a continuous length of rubber stripping that is mounted to a spool. A plurality of spools are positioned on a weaving machine to dispense several strips longitudinally, while one spool is positioned to dispense an interweaving rubber strip longitudinally, thereby weaving a matting having predetermined dimensions and configurations.

The various features of novelty which characterize the invention are pointed out with particularity in the claims annexed to and forming a part of this disclosure. For a better understanding of the invention and method thereof, reference should be had to the accompanying drawings and descriptive matter in which there is illustrated and described the preferred embodiment of the invention.

BRIEF DESCRIPTION OF THE DRAWINGS

FIG. 3 is a plan view which illustrates a matting having a common weave pattern and configuration with the warp and weft of uniform width and spacing, and which further shows the weft component circling the metal cable which defines the outermost warp strip;

FIG. 4 is a pictorial view of one use of the matting which is supported by a cable hanging across a stream bed;

DETAILED DESCRIPTION OF THE PREFERRED EMBODIMENT

Figure 1:
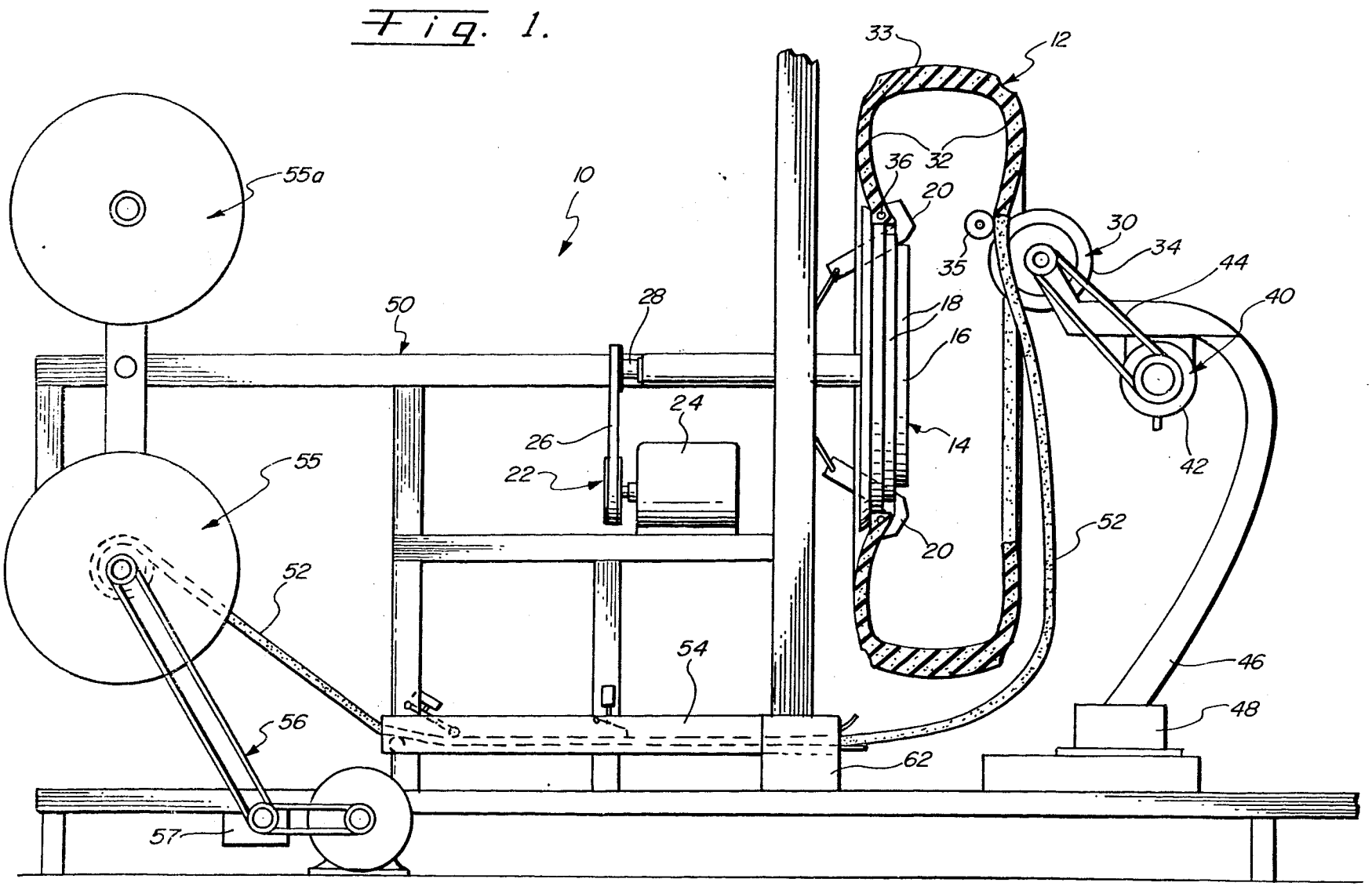
FIG. 1 is a schematic view of the mounting and cutting of the tire wherein the strip being cut is transported to a mounting spool.
Figure 6:
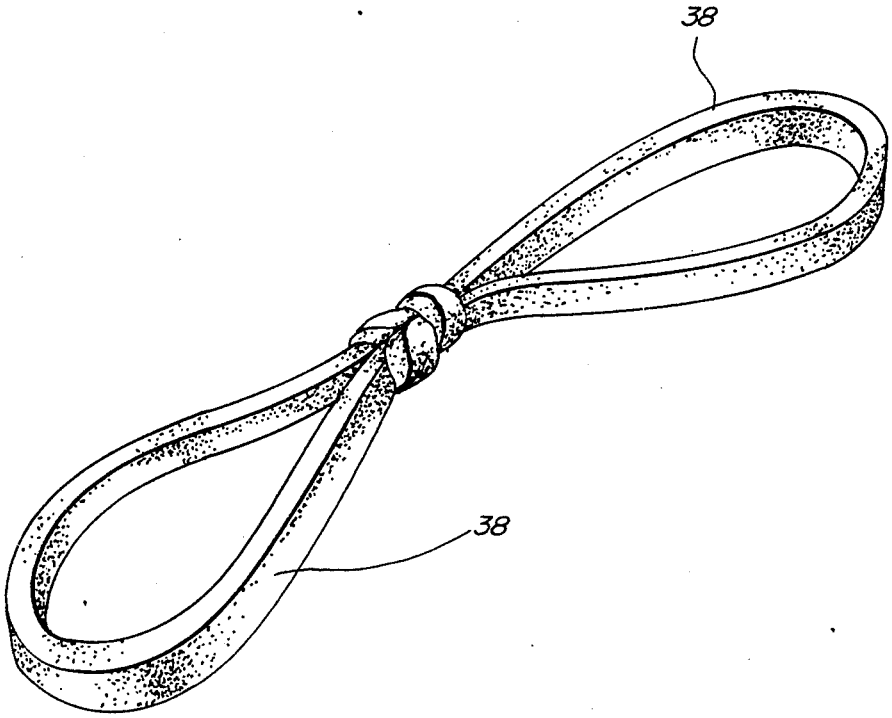
FIG. 6 is a perspective view of two circular beads of the inner rim of a tire linked together without cutting either component.

Referring more particularly to FIG. 1, there is shown a schematic view of a tire-stripping apparatus, generally indicated at 10, which provides a means to rotatably support various sizes of used vehicle tires 12. The rotatable tire-support means, designated generally at 14, has a mounting body 16 which is a circular plate having a plurality of annular shoulders 18 to cooperate with specific tire sizes. Accordingly, tires that are commonly used can be readily mounted on the rotatable mounting body 16 and secured thereon by any suitable means, such as latching tongue members 20. Body 16 is provided with a drive means, designated at 22, which is shown having a drive motor 24, and a belt and pulley system 26, for rotating shaft 28 of body 16. However, various suitable drive means can be employed to rotate body 16 so as to provide a continuous spinning of tire 12. Preferably, the tire is rotated clockwise while a tire-cutter means 30 engages the side walls 32 and tread wall 33. When tire 12 is first mounted to body 16, cutter means 30 is positioned so that cutting blade 34, guided by cutting guide 35, cuts inner rim member 36 of the tire in a complete circle, providing a circular bead 38 which is used in various matting arrangements. FIG. 6 shows two circular beads that are secured together in a linking arrangement. It is contemplated that several tire beads 38 can be linked together to form various warps or wefts as the case may be for the particular matting.

The cutter 34 is operated by its own drive means 40, including a drive motor 42 and a belt 44. It is contemplated that the drive means 40 will be mounted to a tire-cutting framework 46 which is rotatably supported by a rotatable base unit 48.

All of the above-described components are supported on a framework, generally indicated at 50, which is transportable so as to be located adjacent a used tire storage dump (not shown).

Accordingly, as tire 12 rotates, cutter blade 34 engages the walls of the tire and cuts a strip 52 of a predetermined width for the particular type of matting arrangement. As illustrated in FIG. 1, tire strip 52 is guided by guide means 54, whereby the strip is engaged and continuously wrapped about a spool 55. The spool is rotated by means of a drive system 56, includingg a clutch brake 57 which is arranged to pull strip 52 through guide means 54. When spool 55 is fully loaded, it is removed and placed on a rack, which will be described hereinafter. Spool 55*a* replaces spool 55 so that it, too, can be loaded with a continuous rubber-tire strip.

When the stripping of a tire ends before one of the spools is fully loaded, a second tire is mounted for cutting. The free end of the first tire strip is stopped so that it is stationed in a splicing box, indicated at 62. The forward free end of the second tire is positioned in the coupling or splicing box 62 together with the finished end of the preceding tire strip. At this time, a splicing means is activated, thereby securing the two free ends together so as to form a continuous strip. Thus, each spool supports a full continuous strip of rubber made from one or more tires.

Therefore, the first major step of the present method of forming a matting is the cutting of any type of vehicle tire, whether it be a steel-belted or a regular tire; and this is accomplished by providing continuous strips of predetermined width, thickness and shape. Depending on the size of the tire and the width of the strips, each tire will yield approxmmiately 100 to 200 feet of stripping. As previously mentioned, the stripping from the first tire is attached to the stripping from the second tire, resulting in a continuous length of weavable stripping which is wound onto spools 55.

Figure 2:
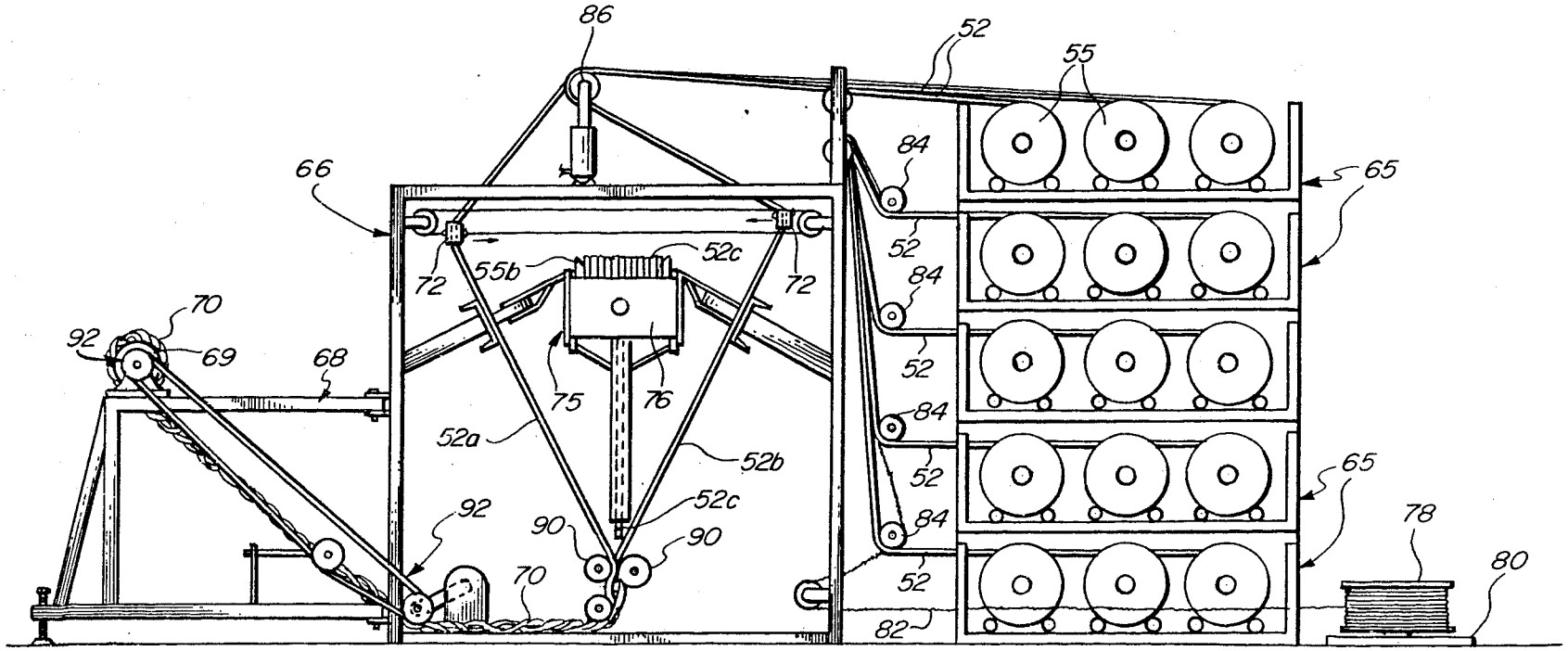
FIG. 2 is a schematic view of the weaving-process unit wherein several spools are positioned on the weaving unit to provide longitudinal strips with a shuttle carriage member supporting a spool of rubber stripping for transverse placement within the woven matting.

As each spool is loaded, it is moved and stored on a special pallet, designated at 65, which holds a multiplicity of loaded spools 55 and 55*a* (shown in FIG. 2). The pallets with the spools are superposed, one above the other, and placed adjacent the weaving apparatus, designated generally at 66. The tire strips 52 are positioned so as to be received by weaving apparatus 66 which includes a matting spool rack 68 having a spool 69 on which the finished matting 70 is loaded, a plurality of guide boxes 72 arranged to weave the longitudinal strips (warp strips) 52*a* and 52*b*, and a shuttle drive system, indicated generally at 75. The shuttle drive system includes a carriage member 76 which receives and rotatably supports a spool 55*b* loaded with a continuous tire strip 52*c*. Positioned on both sides of the weaving apparatus is a cable spool 78 mounted on a turntable platform 80. Each turntable feeds cables 82 into respective guide members; and then, like any other warp strip, each cable 82 is woven into the matting being formed and is later employed to connect the fabric together and to an anchor means (not shown).

Strips 52 are pulled off their respective spools, passed under the guide rollers 84 and over a surge coller 86. Then, every other strip is guided to respective left and right guide boxes 72 which alternate back and forth. There are a multiplicity of guide boxes 72 to accommodate the needed strips. Each back-and-forth movement of guide boxes 72 allows shuttle carriage 76 to move back and forth transversely so as to position strip 52*c* between longidutinal warp strips 52*a* and 52*b*. Thus, a controlled weaving action produces a matting which passes between rollers 90 and is wound on spool 69 which is rotated by drive means, designated at 92. When spool 69 is fully loaded, it is removed and replaced with another empty spool. The matting spools are stored in such a manner that they can be easily transported to the area of use.

Figure 5:
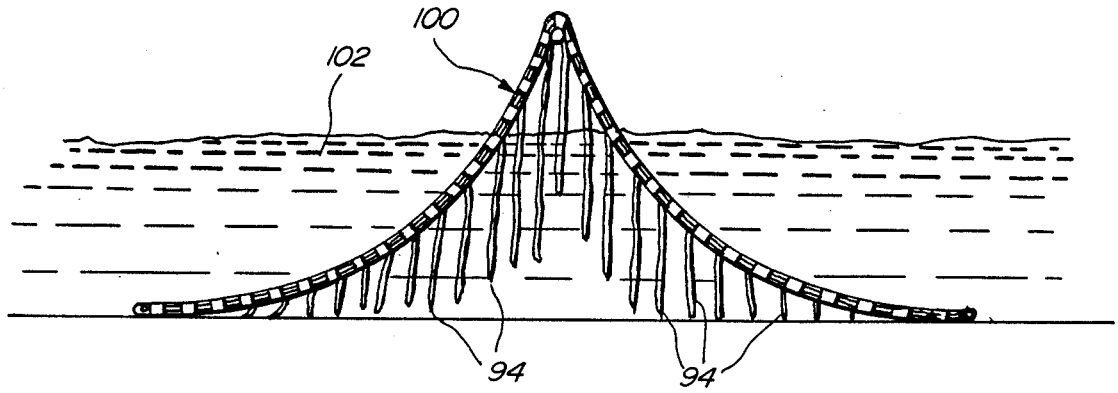
FIG. 5 is a schematic cross-sectional view which illustrates a section of matting suspended across a moving stream or body of water extendingg both upstream and downstream from its cable suspension point, and shows irregular rubber strips that are hung from the matting to act as a coarse filter.

Other by-products are also created in the tire-cutting process. These consist of various irregular lengths and dimensions of rubber strips 94 which result from the trimming of the original tire strips. In certain applications, rubber matting 100 (shown in FIG. 5) will be suspended in and above a moving stream 102 so as to both reduce the stream velocity and cause silt deposition in and around the matting dam. The aforementioned irregular strips 94 will be attached to the underside of matting 100 to accelerate the siltation process. Various suspension means to hang the matting may be used. However, as shown in FIGS. 4 and 5, the matting is suspended by means of a cable wich extends transversely to the flow of water.

Other uses for the matting are contemplated. For example, it can be used for earthen dam faces, and in gullies, stream banks or roadside ditches.

This invention appears to be a unique material well suited for a wide variety of erosion-control applications and, in the preferred embodiment, it will provide a durable and easily installed means of reducing or eliminating erosion in a multitude of high-energy water conditions. The material, made from used vehicle tires, can be woven in various widths and configurations and rolled into place like a piece of heavy carpeting. Being flexible, it can be laid along a stream bank, roadside ditch, gully, earthen dam face or laid in the bottom of a canal to protect the underlying surface from the erosive effects of moving water.

The material can be woven in any weave density. With a closed weave it will provide an impermeable surface to water action, vehicle or foot traffic. In one configuration, the rubber stripping will be cut in the form of an elongated diamond shape so that one piece of stripping will slightly overlap the adjoining strip and be "pinched" together in a weaving process, making a virtually watertight weave. In an open weave configuration, it will encourage the growth up through it of grasses and native vegetation such as trees, shrubs and willows which in turn visually obscure the matting and yet their roots aid in further anchoring the material to the surface.

The invention and its attendant advantages will be understood from the foregoing description; and it will be apparent that various changes may be made in the form, construction and arrangement of the parts of the invention, and the method thereof, without departing from the spirit and scope of the invention or sacrificing its material advantages, and I do not wish to be restricted to the specific arrangement or method mentioned, except as defined in the accompanying claims.

I claim:

1. A method of forming an interwoven matting formed from continuous strips of rubber cut from used vehicle tires, wherein the steps thereof comprise:

stripping vehicle tires, wherein each tire, including the tread and side wall portions, defines a continuous strip, each having a predetermined width, thickness and shape;

attaching at least two of said strips together, end-to-end, whereby a continuous length of rubber stripping is defined;

winding said rubber strips onto a spool holding a predetermined length of continuous rubber stripping;

placing a multiplicity of spools adjacent a weaving machine to dispsense said rubber strips longitudinally onto said weaving machine;

positioning a single spool whereby said rubber stripping thereon is dispensed transverse to the longitudinally disposed rubber strips; and weaving said rubber strips to form a section of interwoven matting having a predetermined dimension and configuration as required for use.

2. The method as described in claim 1, wherein said transverse rubber strips are passed around the outermost positioned longitudinal strips on each edge of the matting, establishing continuity of the weave.

3. The method as described in claim 2, wherein the outermost longitudinal strips are formed of steel cables, thereby defining means for attaching a plurality of interwoven matting sections to each other.

4. The method as described in claim 2, including the step of anchoring said matting to a surface.

5. The method as described in claim 3, including the steps of:

removing the reinforced steel wire or cable inner rims on each side of the tire that define annular beads;

linking a pair of said beads together without said beads being cut; and mounting the interlinked beads transversely and connecting said beads to the oppositely disposed longitudinal steel cables.

6. the method as described in claim 5, including the steps of:

removing the reinforced cable beads annually disposed about the inner diameter on each side of a tire;

linking a pair of beads to define a double strand of rubber-coated cable; and weaving said linked pair of beads as a reinforcing strip into said matting.

7. The method as recited in claim 2, including the step of attaching a plurality of rubber strips of irregular lengths and dimensions to said matting so as to depend from the underside thereof.

8. The method as recited in claim 2, wherein the step of placing said spools to be recived in said weaving machine include:

positioning a multiplicity of strip-loaded spools on a pallet; and attaching said pallets adjacent said weaving machine whereby said strips from said stacked spools enter said weaving machine to form contiguous longitudinal woven warp strips interwoven with said transverse strips so as to define interwoven weft strips of said matting.

9. The method as recited in claim 2, including means for cutting said vehicle tire in a continuous strip.

10. The method as recited in claim 9, including means for attaching said strips, ene-to-end.

11. The method as recited in claim 10, wherein said cutting means include:

a rotatable mounting means; and a cutter means to be removably positioned to cut said vehicle tire in a continuous strip.

12. The method as recited in claim 11, wherein said rotatable mounting means include a drive means.

13. The method as recited in claim 12, wherein said cutter means include:

a cutter blade; and a cutter drive means.

14. The method as recited in claim 10, wherein said weaving machine includes:

a plurality of guide boxes arranged to receive and weave said longitudinal rubber strips; and a shuttle drive means wherein a single spool of stripping is operably disposed to dispense said transverse strip.

15. The method as recited in claim 14, including the step of winding the woven matting onto a matting spool.

16. The method of forming an interwoven fabric defining a matting consisting of strips of rubber cut from used vehicle tires, comprising the steps of:

cutting used vehicle tires to form continuous strips which, when interlaced, define warp strips and weft strips;

forming said warp and weft strips into predetermined lengths and configurations; and interlacing said warp strips and said weft strips by placing said weft strips alternately over and under said warp strips across the transverse extent of the matting whereby said weft strips encircle the outermost warp strips.

17. The method as recited in claim 16, wherein the oppositely disposed outermost warp strips are formed from a metal cable.

18. The method as recited in claim 16, including the step of:

removing the reinforced cable beads annually disposed about the inner diameter on each side of a tire, thereby forming a continuous ring with said cable bead;

looping at least two cable beads together, thereby providing a series of linked beads which form a continuous double-strand cable; and positioning said double-strand cable transversely at intervals between said weft strips of said matting.

19. The method as recited in claim 18, wherein said series of linked beads are positioned in said matting to define the oppositely disposed outermost warp strips disposed along the longitudinal edges of said matting.

20. The method as recited in claim 18, including the steps of:

cutting strips of irregular lengths and dimensions; and attaching said strips to one side of the matting whereby each strip will hang downwardly therefrom to provide means for filtration action on the underside of said matting when said matting is suspended in moving water.

* * * * *